US007259317B2

(12) United States Patent
Hsien

(10) Patent No.: US 7,259,317 B2
(45) Date of Patent: Aug. 21, 2007

(54) PICKUP AND BASE STRUCTURE OF A DRUM HEAD

(76) Inventor: Chao Ying Hsien, P.O. Box 96-556, Taipei 10668 (TW)

( * ) Notice: Subject to any disclaimer, the term of this patent is extended or adjusted under 35 U.S.C. 154(b) by 0 days.

(21) Appl. No.: 11/300,458

(22) Filed: Dec. 15, 2005

(65) Prior Publication Data

US 2007/0137459 A1 Jun. 21, 2007

(51) Int. Cl.
*G10H 3/12* (2006.01)
*G10H 3/00* (2006.01)

(52) U.S. Cl. ..... 84/723; 84/730; 84/746

(58) Field of Classification Search ..... 84/723, 84/730, 746

See application file for complete search history.

(56) References Cited

U.S. PATENT DOCUMENTS 3,509,264 A * 4/1970 Green ..... 84/725
3,725,561 A * 4/1973 Paul ..... 84/726
4,168,646 A * 9/1979 May ..... 84/723
4,226,156 A * 10/1980 Hyakutake ..... 84/730
4,570,522 A * 2/1986 May ..... 84/723
4,984,498 A * 1/1991 Fishman ..... 84/730
5,042,356 A * 8/1991 Karch ..... 84/725
5,105,710 A * 4/1992 Rothmel ..... 84/730
5,134,920 A * 8/1992 Clark ..... 84/730
5,293,000 A * 3/1994 Adinolfi ..... 84/730
5,345,037 A * 9/1994 Nordelius ..... 84/730
5,583,307 A * 12/1996 Tobia, Jr. ..... 84/411 R
5,977,473 A * 11/1999 Adinolfi ..... 84/723
6,031,176 A * 2/2000 Tanaka ..... 84/735
6,121,528 A * 9/2000 May ..... 84/411 R
6,794,569 B2 * 9/2004 Kamijima et al. ..... 84/746
D497,935 S * 11/2004 Kamijima et al. ..... D17/22
2003/0131721 A1 * 7/2003 Minakuchi et al. ..... 84/726
2004/0211310 A1 * 10/2004 Hagiwara et al. ..... 84/726
2005/0016367 A1 * 1/2005 Hasenmaier ..... 84/723

* cited by examiner

*Primary Examiner*—Lincoln Donovan
*Assistant Examiner*—Robert W. Horn
(74) *Attorney, Agent, or Firm*—Troxell Law Office PLLC

(57) ABSTRACT

This invention relates to a pickup and base structure of a drum head, in particular, a pickup applied to a mesh head or a hard drum head having the base thereof in a hollow L-shape, thereby allowing a vertical space to position a terminal base of a signal line and a horizontal portion in a L shape to form a recess inwards. A shock isolator is integrally formed with the pickup in one piece by clamping said pickup from both above and below, in addition, another shock isolator is fastened on the vertical side on the exterior of the base. The structure is fixed on the underside of the drum head and the shock isolator that is fastened on the vertical side on the exterior of the base is against on a position corresponding to the drum body, so as to form the pickup and base structure of a drum head that is easily to be installed.

1 Claim, 6 Drawing Sheets

PICKUP AND BASE STRUCTURE OF A DRUM HEAD

BACKGROUND OF THE INVENTION (1) Field of the Invention

This invention relates to a pickup and base structure of a drum head, in particular, a pickup applied to a mesh head or a hard drum head having the base thereof in a hollow L-shape, thereby allowing a vertical space to position a terminal base of a signal line and a horizontal portion on the exterior thereof in a L shape to form a recess inwards. Shock isolators are integrally formed with the pickup in one piece by clamping said pickup from both above and below; in addition, another shock isolator is fastened on the vertical side on the exterior of the base. The structure is fixed on the underside of the drum head and the shock isolators that are fixed on the vertical side on the exterior of the base are against on the positions corresponding to the drum body, so as to form the pickup and base structure of a drum head that are easily to be installed.

(2) Description of the Prior Art

Generally, a jazz tomtom is a musical percussion instrument that is able to directly bring about empathy between a drummer and his/her audience. Seeing that musical sound is produced by the skills of a drummer, i.e., "practice makes perfect", so that a professional drummer or a learner has to ceaselessly practice the skills of beating a drum to make progress, so as to be familiar with the real response from beating a tympan (the head of a drum) of a jazz tomtom and improve the percussion skills.

However, the total percussion sound volume resulting from the beating of a jazz drum is likely to have an impact on others, especially on those who mostly live in congregate housing. Soundproof room partitions is one of the problem-solving ways to deafening drumbeats, nevertheless, such a manner is unable to be afforded by each drummer to avoid others from the deafening drumbeating sound volume for the limitation in interior space and construction cost, etc. Consequently, a "drum muffler" structure is produced by a mesh tympan, differing from the tympan structure of a jazz tomtom that is made from polyster film, i.e., the sound from beating of the drum is lower than that of a traditional jazz tomtom, when said mesh tympan is mounted and tensioned within the drum rim, in addition, such a real tympan design performs excellent response and is popular among drummers for muffling sound to appease their roommate, parents, and neighbors.

Such a drum muffler may perform a similar sound quality as natural acoustic sound of a jazz tomtom; nevertheless, the beating sound still has considerable nuances differing from the sound quality that is performed by a real jazz tomtom.

In view of the forgoing, the objective of the invention is to install a pickup on a drum muffle head connecting the host, thereby enabling a drummer to have the same beating feeling performed by a conventional drum; in addition, the sound of the drum body is transmitted to the earphones of the drummer by the host sound simulation. The invention, therefore, provides the structure for effectively solving said problems.

SUMMARY OF THE INVENTION

The main objective of the invention especially relates to a pickup and base structure of a drum head, which is applied to a mesh tympan or a hard tympan with excellent sound effect, having a simplified structure easily to be installed. The structure of the invention is described as follows:

a base is formed as a hollow L shape, allowing a vertical space thereof to position a terminal base;

a recess is formed inwards in a L shape on a horizontal portion of the exterior of the base for fixing a pickup, which is clamped by shock isolators from above and below, both forming in one piece;

another shock isolator is positioned on the vertical side on the exterior of the base;

the pickup and base structure is fixed and against on the underside of the drum muffle head; in addition, a plurality of bolts pierce through the surface of the drum muffle head and are screwed to correspondent threaded apertures on the base; a plurality of joint holes on the terminal base running through said drum muffle head are fixed through screws. Therefore, when said mesh tympan is mounted and tensioned, the pickup and said shock isolators are against on the underside of the drum muffle head and the shock isolators that are fixed on the vertical side on the exterior of the base are against on positions corresponding to the drum body.

DETAILED DESCRIPTION OF THE PREFERRED EMBODIMENTS

Further aspects, objects, and desirable features of the invention will be better understood from the detailed description and drawings that follow in which various embodiments of the disclosed invention are illustrated by way of examples.

Figure 1:
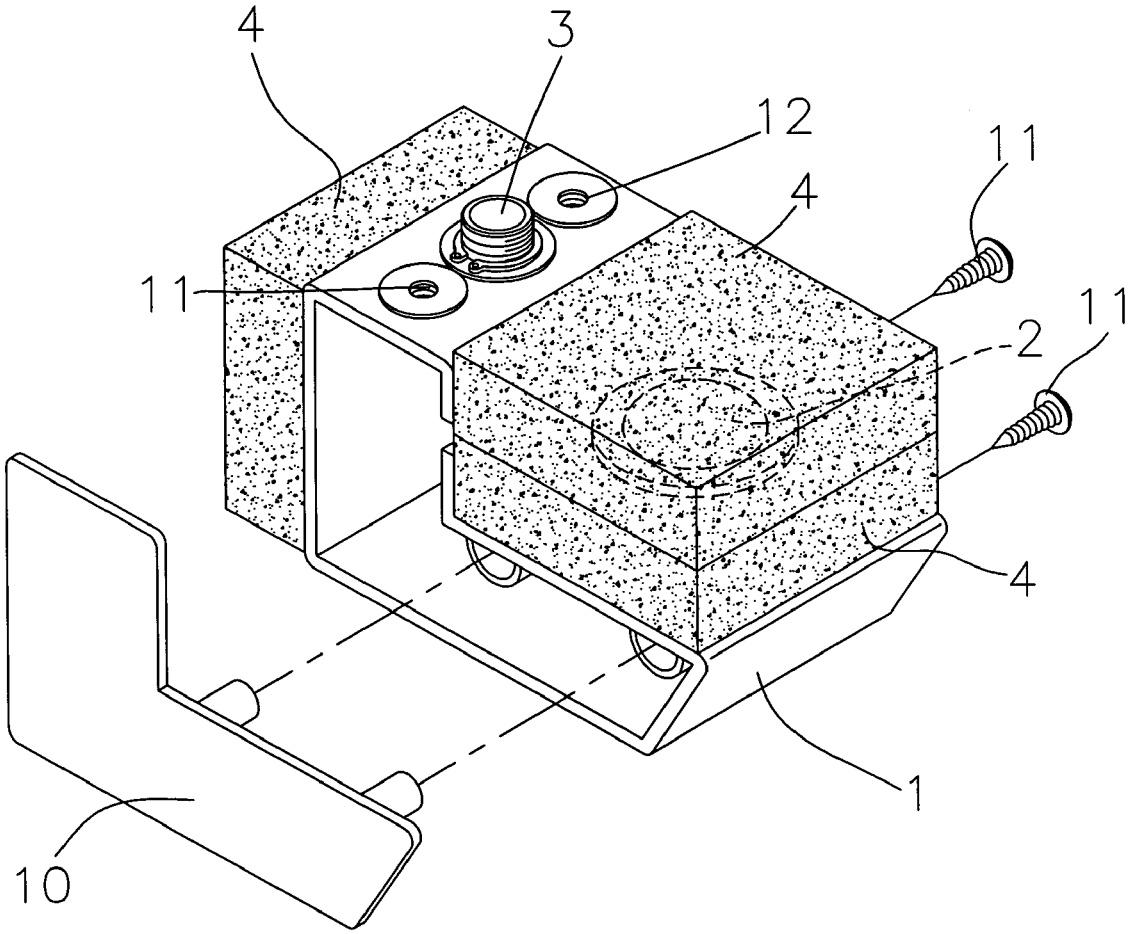
FIG. 1 is an exploded view showing a preferred embodiment of the invention.
Figure 2:
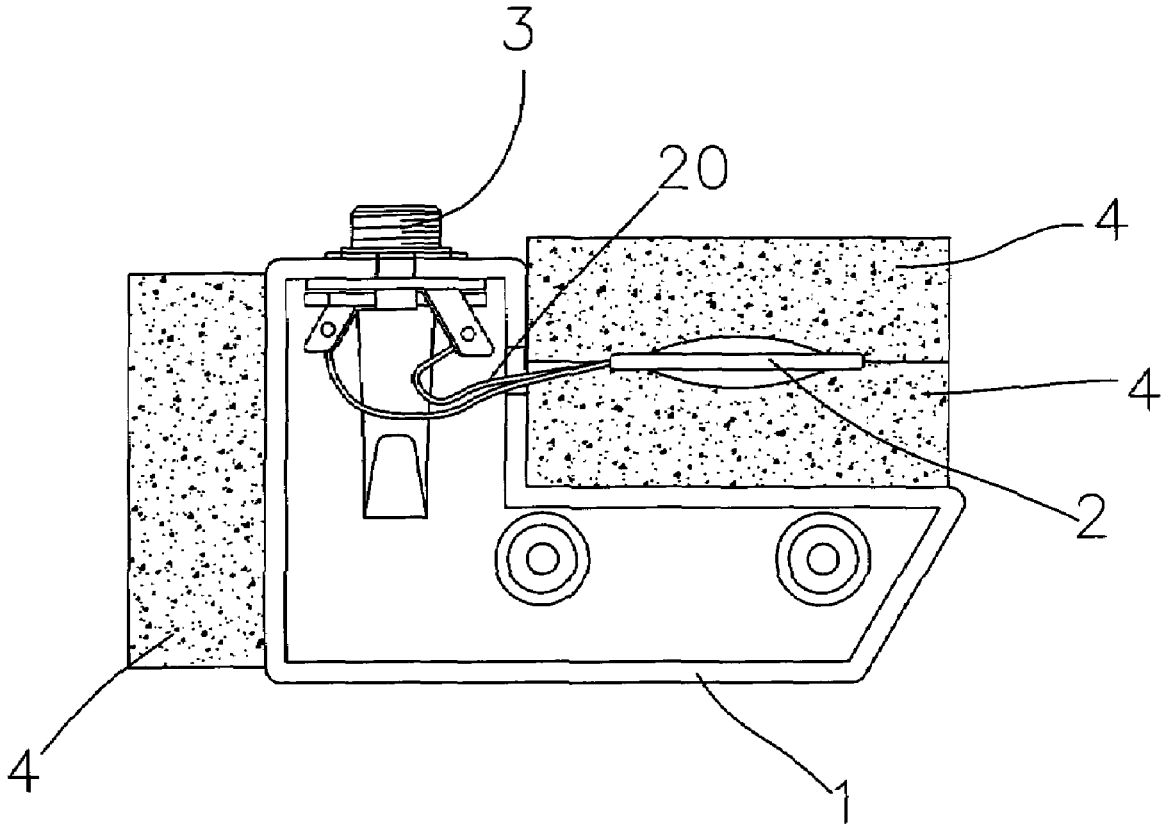
FIG. 2 is a cross-sectional view showing the assembly of a preferred embodiment of the invention.

With reference to FIG. 1 showing an exploded view of the structure, the invention comprises a base (1) and a pickup (2), wherein:

the base (1) is formed as a hollow L shape, having an opening on one lateral side thereof and using bolts (11) to screw a sheathing (10) together;

a terminal base (3) is positioned on a vertical space of the base (1), in addition, joint holes (30) on both lateral sides of the terminal base (3) on the surface of the base (1) have threaded apertures (12) respectively set thereof;

a recess is formed inwards in a L shape on a horizontal portion of the exterior of the base (1) for fixing the pickup (2), which is clamped by shock isolators (4) from above and below, both forming in one piece, subsequently, the piece is fixed in the recess of the base (1); a signal line (20) of the pickup (2) is put on the space in the base (1) and combined with the terminal base (3);

another shock isolator (4) is positioned on the vertical side on the exterior of the base (1). FIG. 2 is a cross-sectional view showing the assembly of a preferred embodiment of the invention.

Figure 3:
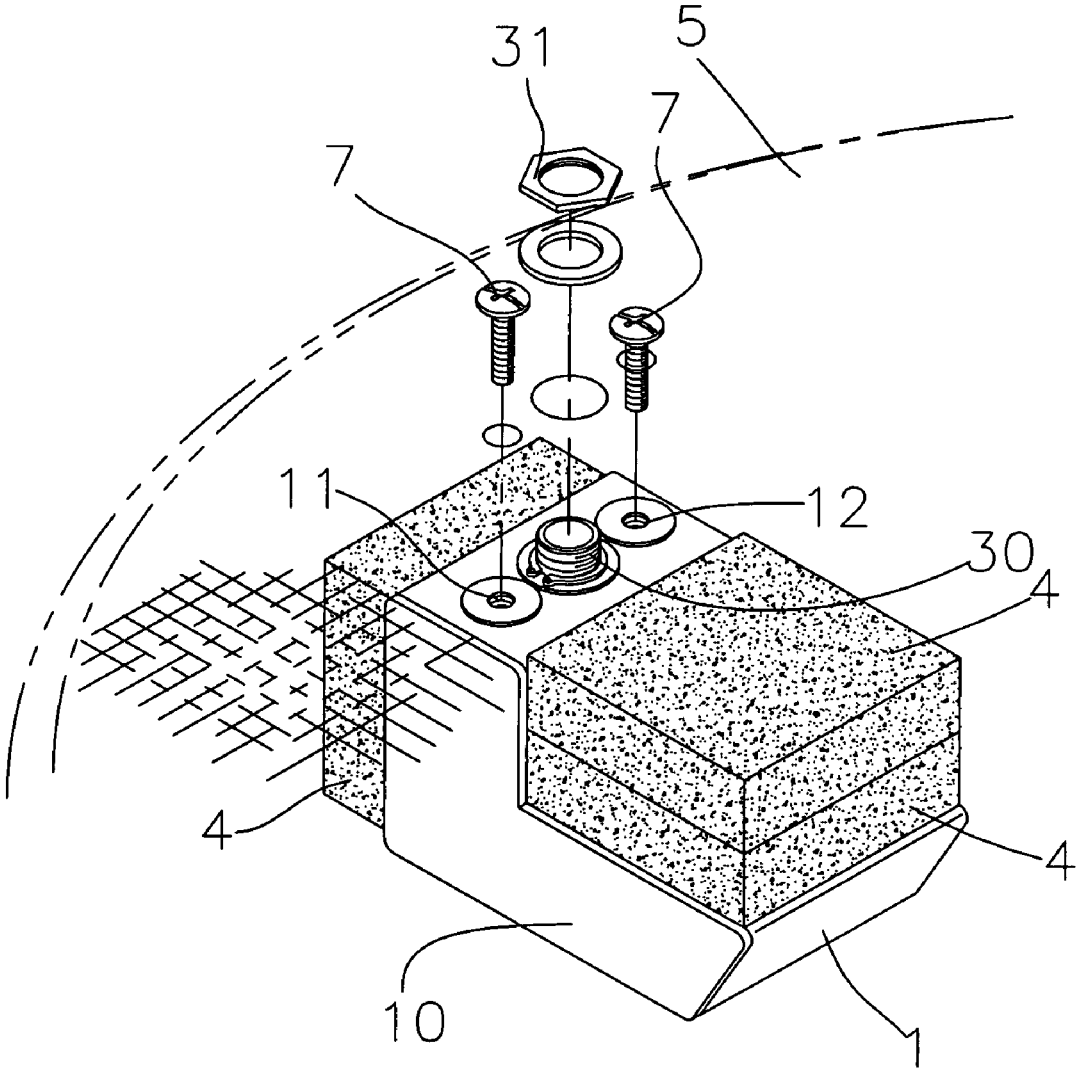
FIG. 3 is a perspective view showing the assembly of a tympan of the invention.
Figure 4:
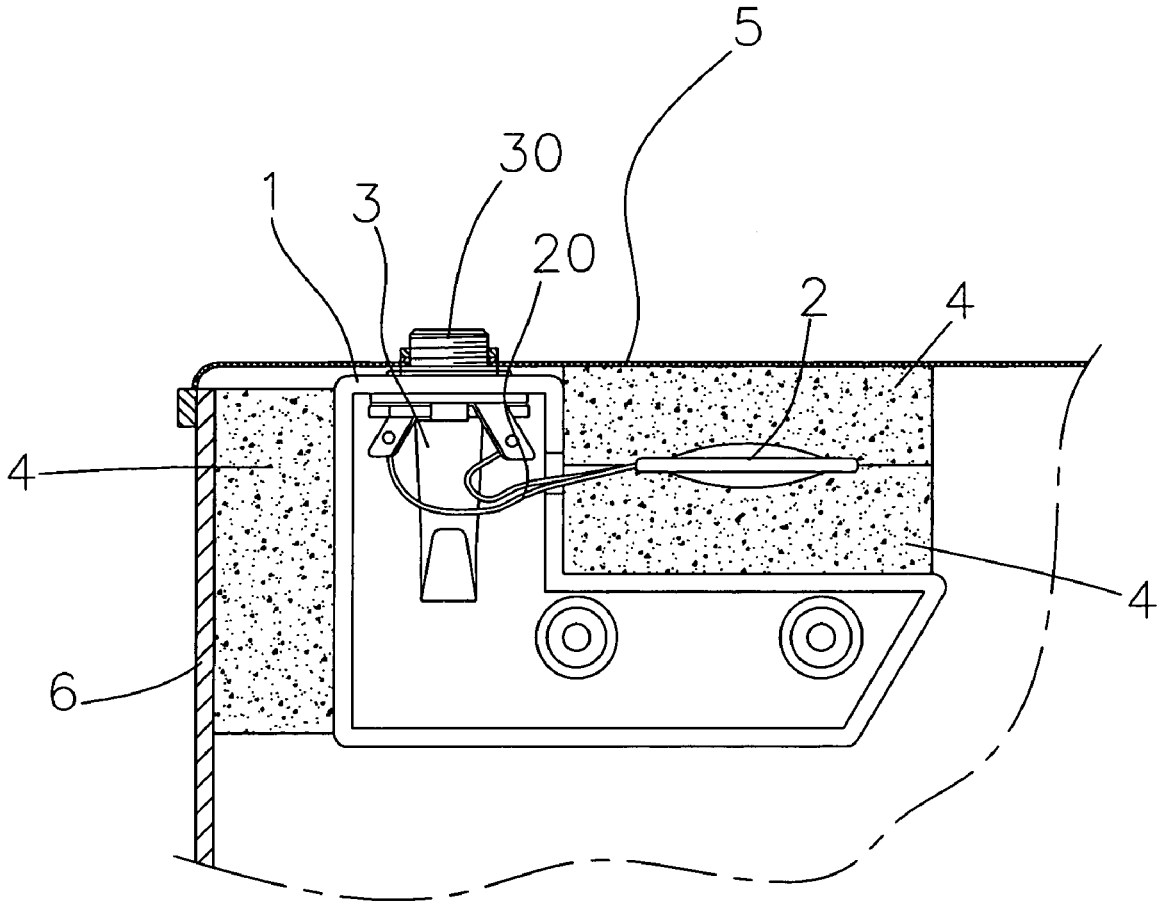
FIG. 4 is a cross-sectional view showing the assembly of a tympan of the invention.

Accordingly, as shown in FIGS. 3 and 4, the invention is fixed on the underside of the mesh drum muffle head (5) for use. A plurality of holes (50) are pre-set on lateral sides of the drum muffle head (5), the base (1) and the pickup (2) are assembled and leaned against on the underside of the drum muffle head (5); in addition, a plurality of bolts (7) pierce through the surface of the drum muffle head (5) and are screwed to correspondent threaded apertures (11) and (12) on the base (1). A plurality of joint holes (30) on the terminal base (3) running through said drum muffle head (5) are fixed through screws (31). Therefore, when said mesh tympan is mounted and tensioned, the pickup (2) and said shock isolators (4) are against on the underside of the drum muffle head (5) and the shock isolators (4) that are fixed on the vertical side on the exterior of the base (1) are against on positions corresponding to a drum body (6).

Figure 5:
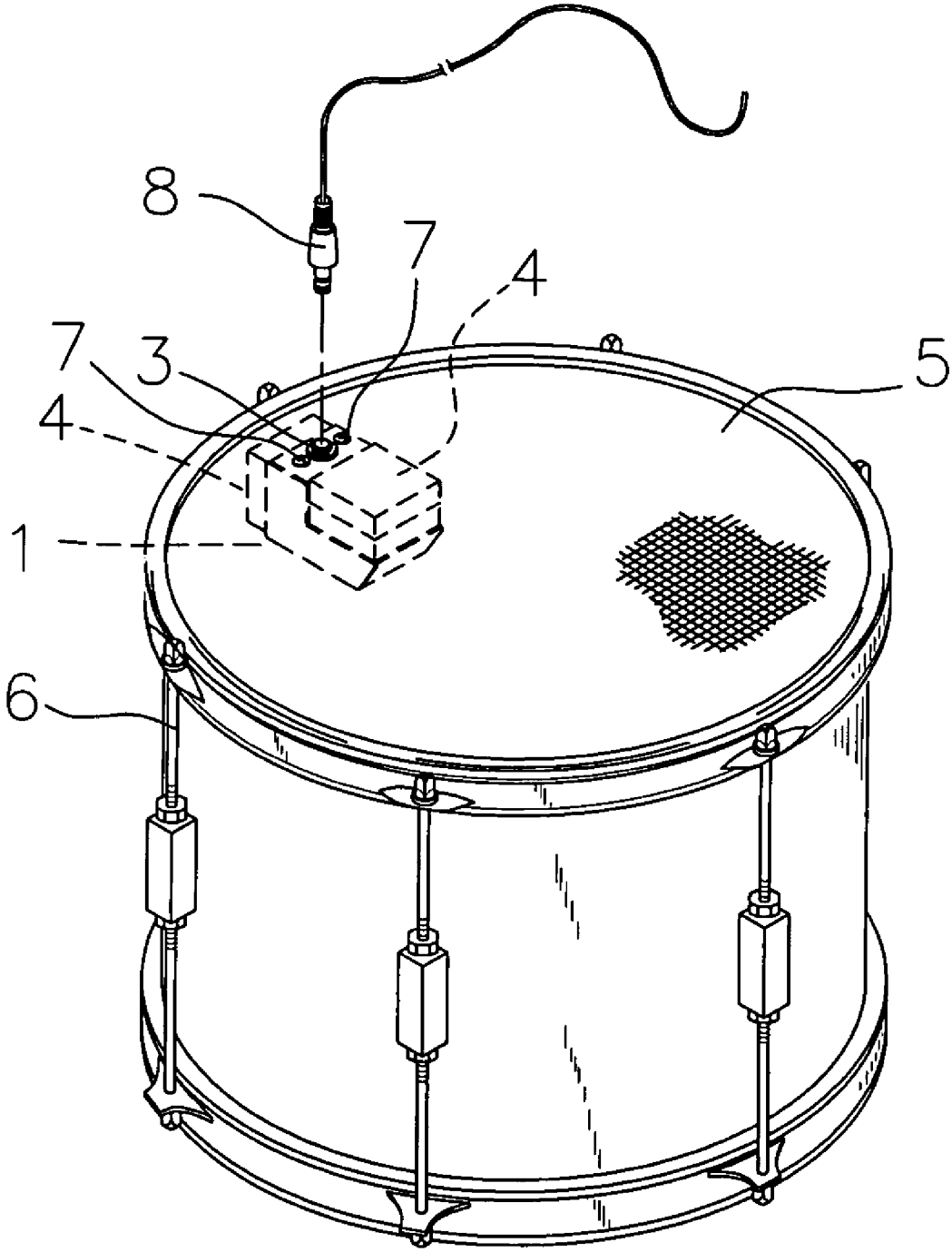
FIG. 5 is a perspective view showing the connection of a signal wire and the host according to the invention.

A signal line (8) connects terminal base (3) to pick up and transmit a beating signal to a host (not shown), as shown in FIG. 5.

Figure 6:
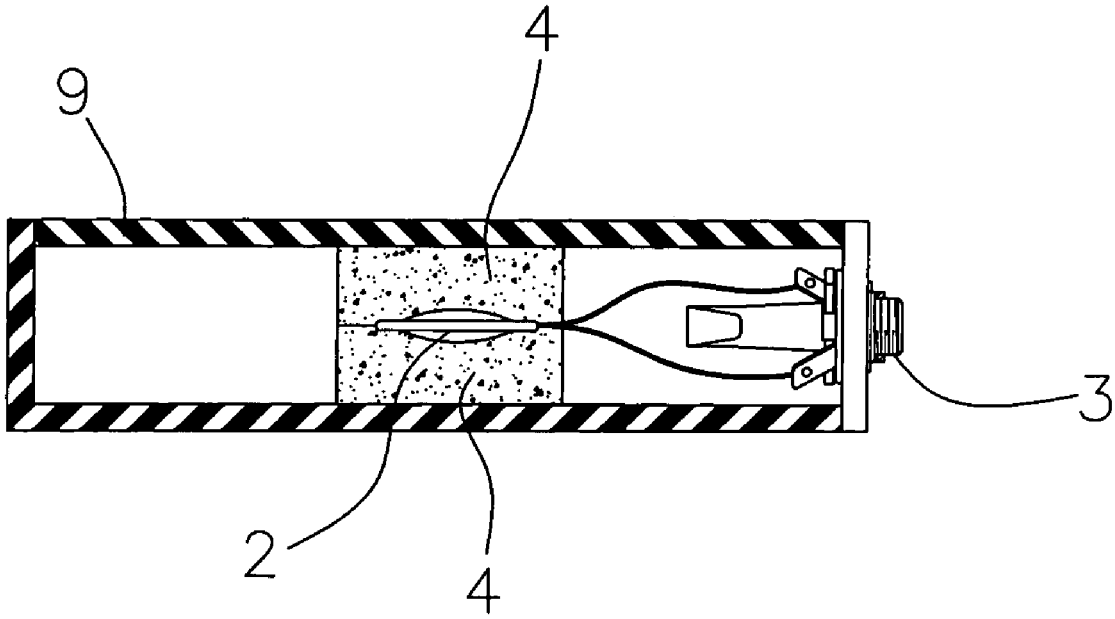
FIG. 6 is a schematic view showing the application of the invention to a hard tympan (percussion pad).

The invention is able to be applied to a mesh drum muffle head, a hard tympan (percussion pad) (9) is also within the application scope of the invention, as shown in FIG. 6.

Consequently, the combination of the structure of the invention and the tympan forms a simplified structure easily to be installed without additional kits needed and allows an excellent sound quality to be performed. When the tympan is tensioned, the shock isolators (4) and the pickup (2) are against the underside of the head of a drum and the lateral sides of the shock isolators (4) are against the drum body.

In conclusion, said "drum pickup and base structure" of the invention possesses excellent practical effect in the field.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A pickup and base structure of a tympan of a drum comprising:

a base and a pickup;

the base is formed as a hollow L shape, having an opening on one lateral side thereof and using bolts to screw a sheathing together;

a terminal base is positioned on a vertical space of the base, in addition, joint holes on both lateral sides of the terminal base on the surface of the base have threaded apertures respectively set thereof;

a recess is formed inwards in a L shape on a horizontal portion of the exterior of the base for fixing the pickup;

shock isolators from above and below, fixed in the recess of the base, clamp the pickup in the base;

a signal line of the pickup is put on the space in the base and combined with the terminal base;

another shock isolator is positioned on the vertical side on the exterior of the base;

a mesh drum muffle head;

a plurality of holes are pre-set on lateral sides of the mesh drum muffle head, the base and the pickup are assembled and leaned against on the underside of the drum muffle head, a plurality of bolts pierce through the surface of the drum muffle head and are screwed to corresponding threaded apertures on the tympan (the head of a drum) of the base;

a plurality of joint holes on the terminal base running through said drum muffle head are fixed through screws;

when said mesh tympan is mounted and tensioned, the pickup and said shock isolators are against on the underside of the drum muffle head and the shock isolators that are fixed on the vertical side on the exterior of the base are against it on positions corresponding to a drum body;

the simplified structure may easily be installed without additional kits and allows an excellent sound quality.

* * * * *